US005800313A

United States Patent [19]

Yu

[11] Patent Number: 5,800,313

[45] Date of Patent: Sep. 1, 1998

[54] SKIING EXERCISE APPARATUS

[76] Inventor: Hui-Nan Yu, 5F-23, 70, Fu-Shing Road, Taoyuan, Taiwan

[21] Appl. No.: 850,017

[22] Filed: May 1, 1997

[51] Int. Cl.[6] ..... A63B 22/14

[52] U.S. Cl. ..... 482/53; 482/71; 482/146

[58] Field of Search ..... 482/71, 70, 51, 482/52, 53, 79, 80, 111, 112, 146, 147; 601/27, 33, 34, 35

[56] References Cited

U.S. PATENT DOCUMENTS

| | | | |
|---|---|---|---|
| 5,232,421 | 8/1993 | Chen et al. | 482/53 |
| 5,246,410 | 9/1993 | Fun | 482/53 |
| 5,298,002 | 3/1994 | Lin | 482/53 |
| 5,453,065 | 9/1995 | Lien et al. | 482/146 |
| 5,527,253 | 6/1996 | Wilkinson et al. | 482/52 |
| 5,536,225 | 7/1996 | Neuberg et al. | 482/71 |
| 5,545,111 | 8/1996 | Wang et al. | 482/53 |
| 5,628,709 | 5/1997 | Chen | 482/53 |
| 5,645,512 | 7/1997 | Yu | 482/53 |

*Primary Examiner*—Stephen R. Crow
*Attorney, Agent, or Firm*—Bacon & Thomas

[57] ABSTRACT

A skiing exercise apparatus, has an angled swinging seat at a fore end of a pedestal, on which are installed hydraulic cylinders and a pair of pedals which pull each other when treaded. Two handles are fitted to an upright axle in a socket at the fore end of the pedestal so that the user can hold the handles to exercise by swinging back and forth achieving the effect of body-building through imitating the exercise of skiing.

5 Claims, 6 Drawing Sheets

SKIING EXERCISE APPARATUS

BACKGROUND OF THE INVENTION

The invention is related to an improvement for an exercise device, more particularly an improved structure for a skiing exercise apparatus.

As shown in FIG. 1, the conventional skiing exerciser involves the use of a dynamic control design with a swinging seat 1' sliding on a slide board to the effect that the user can tread on the pedals imitating skiing exercise. The problem is that, the above-mentioned skiing exerciser is complex in structure, comprising many components, and thus is time-consuming to assemble and high in production costs, resulting in low productivity and use.

SUMMARY OF THE INVENTION

Therefore, the main objective of the present invention is to provide a skiing exercise apparatus which is simple in structure, easy to assemble thus low in production costs, and which at the same time can still achieve the same effect of imitating a skiing exercise.

The skiing exercise apparatus according to the present invention has an angled swinging seat at a fore end of a pedestal, on which are installed hydraulic cylinders and a pair of pedals which pull each other when treaded. Two handles are fitted to an upright axle in a socket at the fore end of the pedestal so that the user can hold the handles to exercise by swinging back and forth achieving the effect of body-building through imitating the exercise of skiing.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
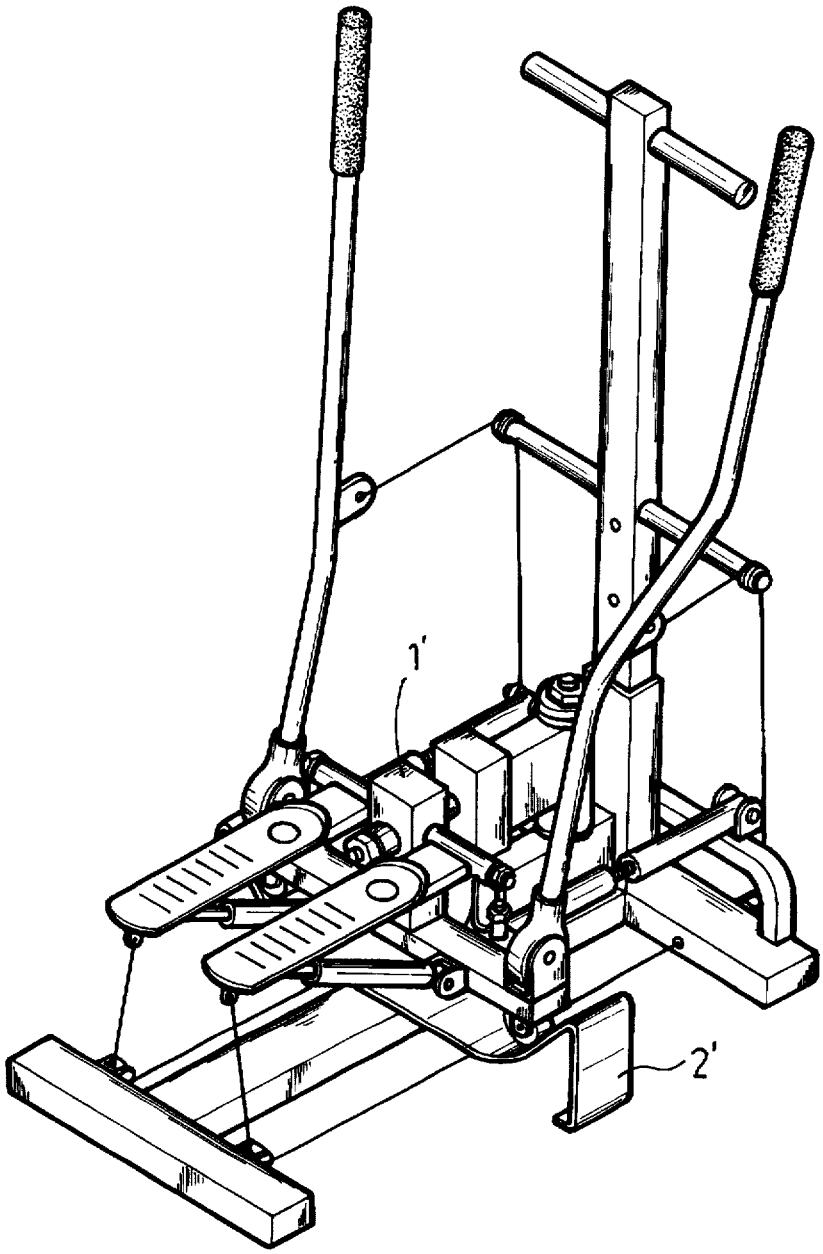
FIG. 1 PRIOR ART
FIG. 1 is a perspective view of a conventional skiing exercise apparatus.
Figure 2:
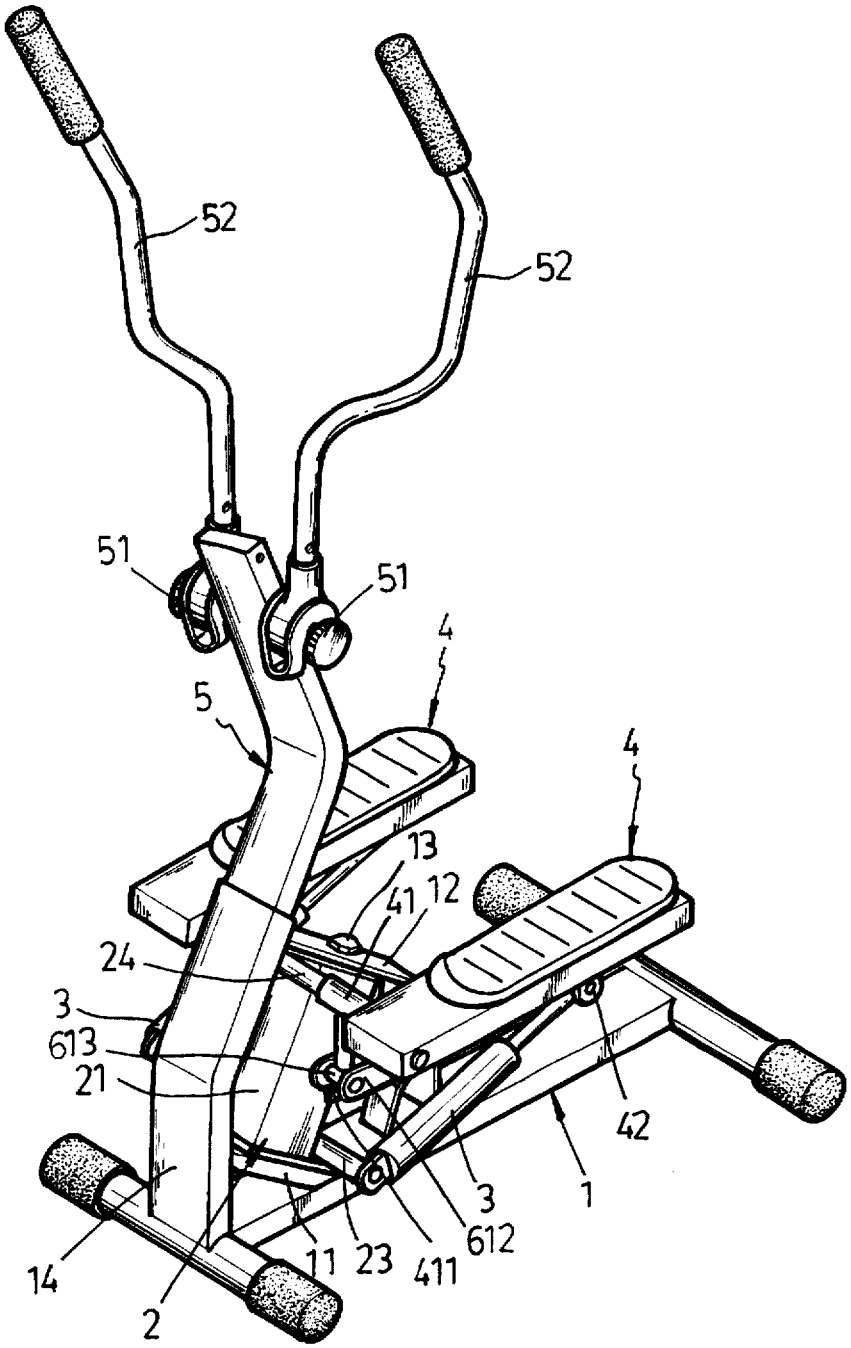
FIG. 2 is a perspective view of the present invention.
Figure 3:
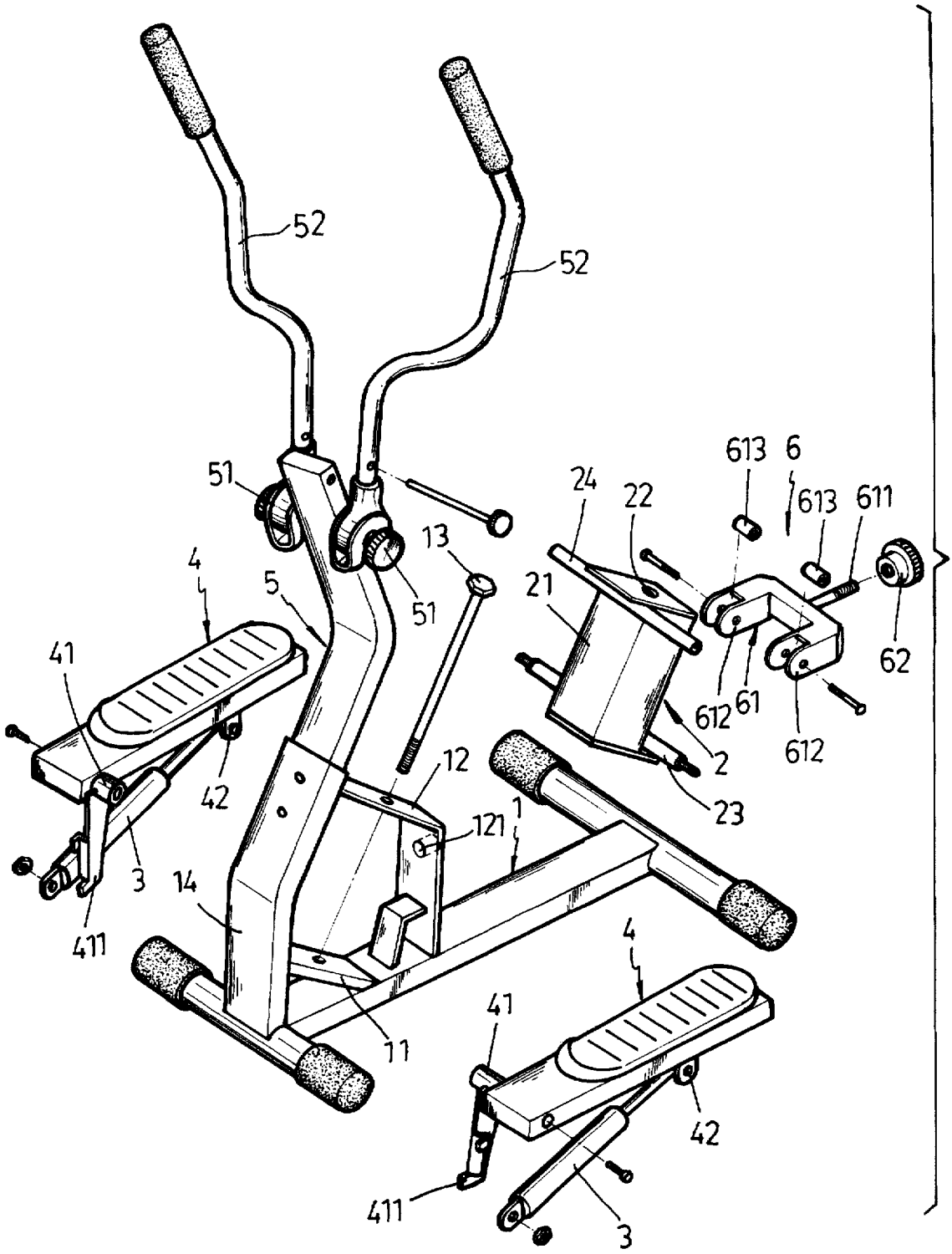
FIG. 3 is an exploded perspective view of the present invention.

Please refer to FIGS. 2 and 3 for the structure of the present invention. At the fore end of a pedestal 1 is connected in an angled position, a back plate 11. Above the back plate 11 is an extension plate 12 curving upward. The back plate 11 and the extension plate 12 accommodate a shaft 13. Between the back plate 11 and the extension plate 12 a swinging seat 2 is fitted, the support portion 21 of which is located between back plate 11 and extension plate 12. A hole 22 is formed in a side surface of the swinging seat 2 to hold the shaft 13 so that swinging seat 2 can rotate on the shaft 13 relative to pedestal 1. A bottom of the swinging seat 2 has a connecting rod 23, each end of which is fitted to an hydraulic cylinder 3. A top of the swinging seat 2 has a shaft 24, to which is connected a shaft 41 at the fore end of pedals 4. The shaft 41 at the fore end of the pedal 4 is fixed with a protruding board 411, and an underside of pedal 4 is fitted with a bearing to hold the front shaft of hydraulic cylinder 3, so that the pair of pedals 4 on swinging seat 2 can act in connection with the pair of hydraulic cylinders 3, thus achieving the exercise damping effect on the part of the user when treading on the pedal.

Figure 4:
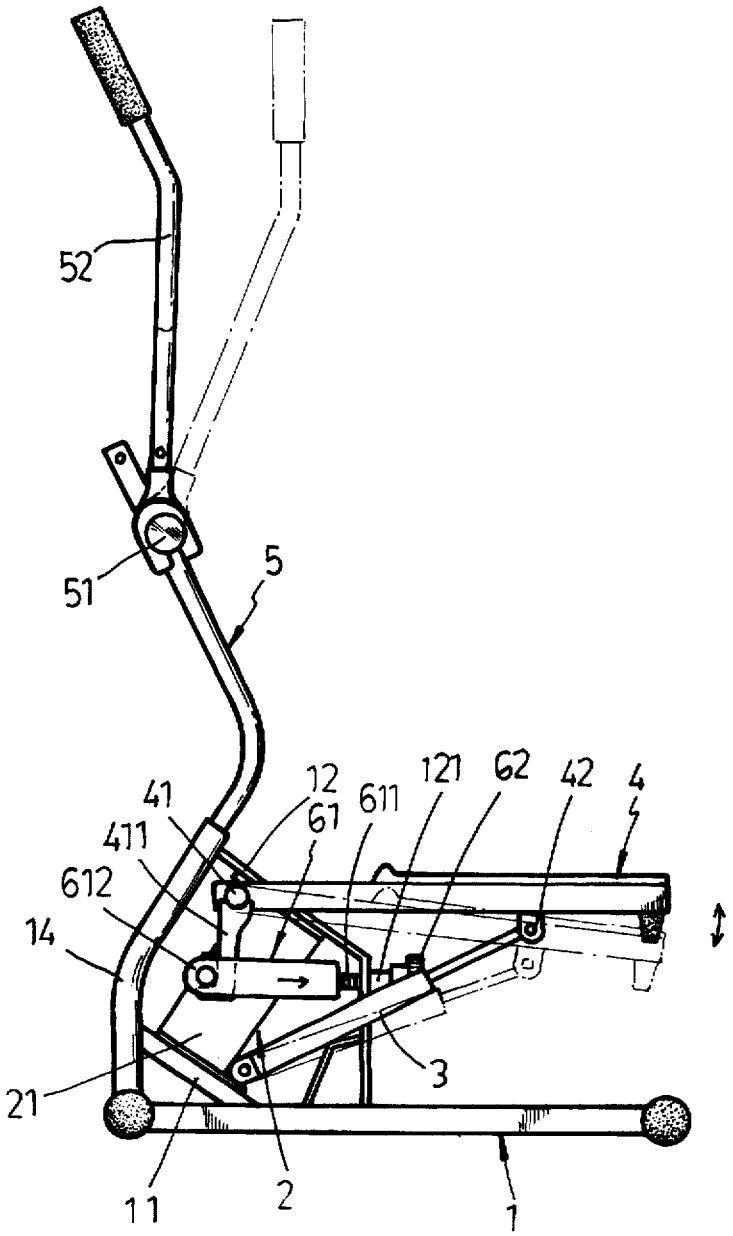
FIG. 4 is a side view illustrating the action of the components in the present invention.

Please refer FIGS. 2, 3, and 4. At the fore end of the pedestal 1 there is a socket 14 with an upright column on the top, an end of which is fitted with a rotating connecting seat 51 connecting to handles 52 so that the pair of handles 52 can move back and forth on the upright column 5, to simulate the effect of skiing.

As shown in FIGS. 2, 3 and 4, the extension plate 12 of the pedestal 1 has a hole 12 on a vertical side surface to hold an adjusting seat 6 composed of a buckling frame 61 and a knob 62. A back of the buckling frame has a spiral rod 611 extending through hole 121 and engaged with knob 62. The front end of the buckling frame 61 has two pairs of lugs 612, each connected to a liner 613 so that protruding boards 411 of pedals 4 can each fit into a lug 612 in contact with the liner 613. When the knob 62 rotates anti-clockwise, the spiral rod 611 of the buckling frame 61, affected by the hitching, will drive the buckling frame 61 backward, and the liner 613 fitted in lug 612 will move the protruding board 411 of the pedal 4 backward so as to control the upward movement of pedal 4, i.e., to adjust the up-and-down swinging of the pedal 4.

Figure 5:
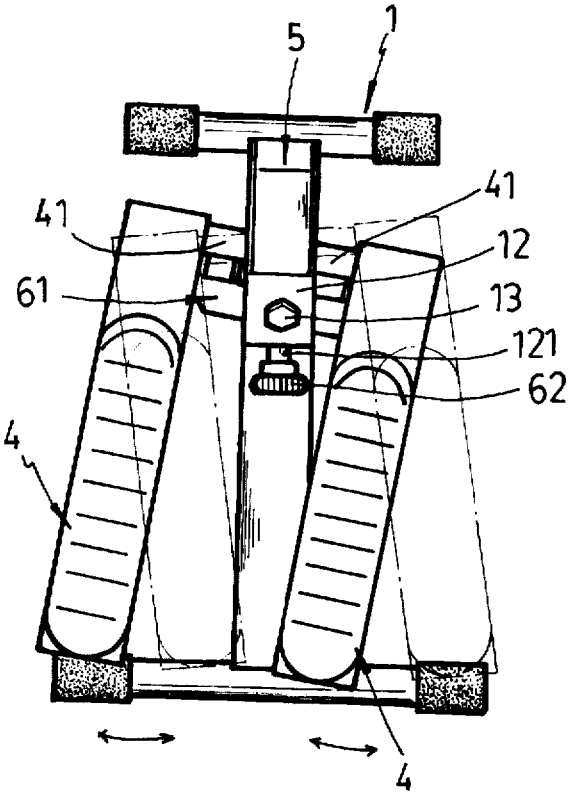
FIG. 5 is a top view illustrating the operation of the pedals according to the present invention.
Figure 6:
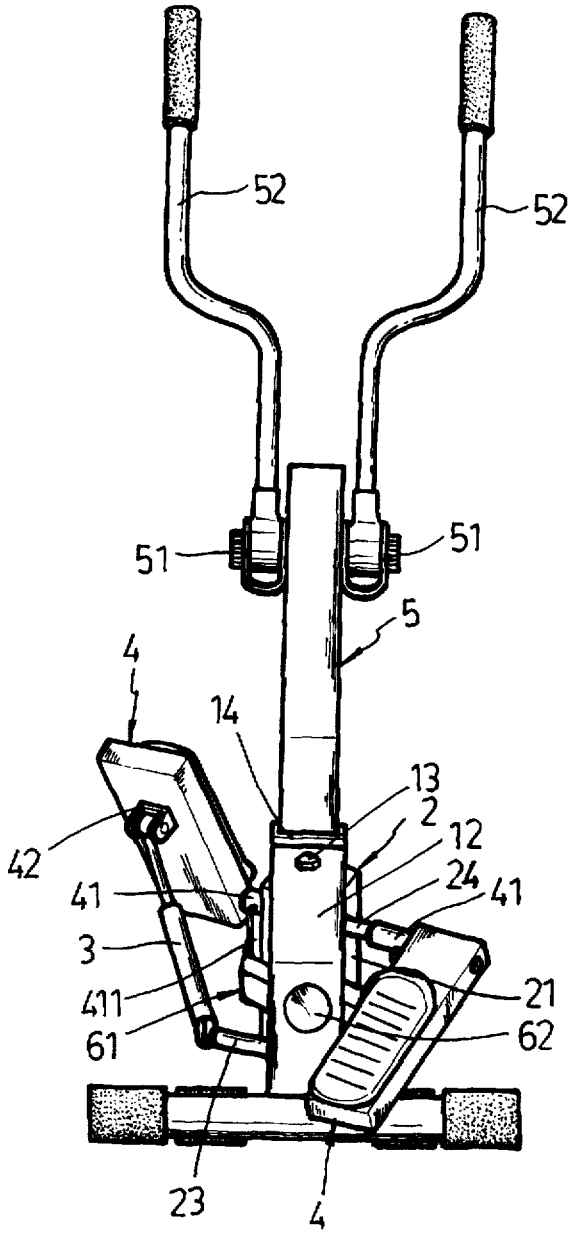
FIG. 6 is a rear view illustrating the operation of the pedals according to the present invention.

Please refer to FIGS. 5 and 6, for operation of the present invention. The user can tread on the pair of pedals 4 and hold the pair of handles 52, and, by means of swinging the swinging seat 2 and its angled position against the pedestal 1, can swing up and down, right and left. In this way, the purpose of body-building by imitating skiing can be fulfilled. The up-and-down swinging distance can be adjusted through the adjusting of the seat 6 and thus can enhance the effect of the exercise, making the present invention practical and advanced.

It can be seen from the above description that the simplicity of structure of the invention makes it easy to assemble at low production cost, while achieving the effect of body-building by imitating the exercise of skiing.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An exercise apparatus simulating the motion of skiing comprising:

a) a pedestal;

b) a swinging seat pivotally connected to the pedestal so as to pivot about an axis extending obliquely to the pedestal;

c) a pair of pedals pivotally connected to opposite sides of the swinging seat;

d) a damping device connected between each pedal and the swinging seat;

e) an adjusting seat connected to both pedals and to an extension plate extending from the pedestal so as to adjust angular positions of the pedals relative to the pedestal;

f) an upright column extending upwardly from the pedestal; and, g) a pair of handles each pivotally connected to the upright column.

2. The exercise apparatus of claim 1 further comprising:

a) a back plate extending between the pedestal and the upright column; and, b) a shaft passing through the extension plate, the swinging seat and the back plate to pivotally support the swinging seat between the back plate and the extension plate.

3. The exercise apparatus of claim 1 further comprising a protruding board extending from each pedal, the protruding boards being connected to the adjusting seat.

4. The exercise apparatus of claim 1 wherein the adjusting seat has a threaded rod extending through the extension plate and engaging a knob.

5. The exercise apparatus of claim 1 further comprising a socket extending upwardly from the pedestal, the upright column being mounted in the socket.

* * * * *